United States Patent [19]

Spinner

[11] Patent Number: 4,847,576

[45] Date of Patent: Jul. 11, 1989

[54] TRANSMITTER/ANTENNA PLUG-IN BOARD

[76] Inventor: Georg Spinner, Am Eichberg 12/8152, Feldkirchen-Westerham, Fed. Rep. of Germany

[21] Appl. No.: 162,109

[22] Filed: Feb. 29, 1988

[30] Foreign Application Priority Data

Mar. 4, 1987 [DE] Fed. Rep. of Germany ..... 3706989

[51] Int. Cl.[4] ..... H01P 5/00

[52] U.S. Cl. ..... 333/260; 439/578

[58] Field of Search ..... 333/260; 439/540, 544, 439/545, 578, 579, 581, 582

[56] References Cited

U.S. PATENT DOCUMENTS 4,124,772 11/1978 Baggianni ..... 333/260 X 4,273,407 6/1981 Snuffer et al. ..... 439/581 X

*Primary Examiner*—Paul Gensler

*Attorney, Agent, or Firm*—Henry M. Feiereisen

[57] ABSTRACT

A transmitter/antenna plug-in board for selectively connecting coaxial lines via flange sockets attached in a front panel includes a transmission line connection manually pluggable on the flange sockets and being provided with a straight inner conductor in form of a strip conductor. Each flange socket has an outer conductor contact flange and an inner conductor which projects beyond the outer conductor contact flange and is contacted by the inner conductor of the transmission line connection. Suitably the carrier safety loop is guided over the transmission line connection with one plug unit being mounted to the front panel and the complementary plug unit being attached to the outer conductor of the transmission line and including at least one short-circuiting bridge.

11 Claims, 2 Drawing Sheets

Fig. 2
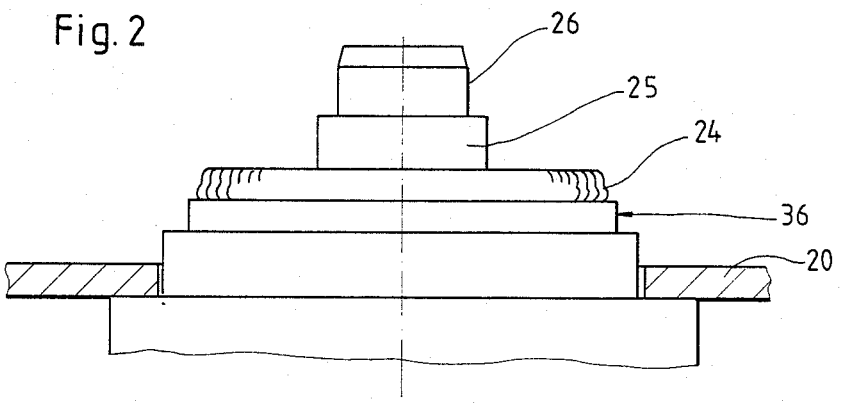
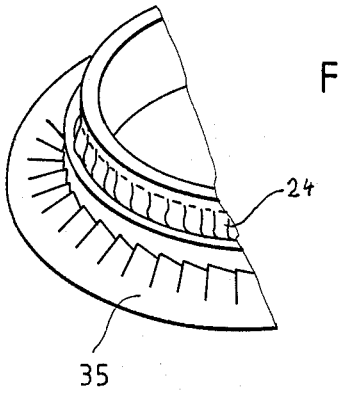
Fig. 3

TRANSMITTER/ANTENNA PLUG-IN BOARD

BACKGROUND OF THE INVENTION

The invention refers to a transmitter/antenna plug-in board for selective connection of coaxial lines.

It is known to link coaxial lines through a transmission line connection which is manually pluggable on flange sockets of the coaxial lines with the flange sockets incorporated in a front panel. The transmission line connection which assigns a certain transmitter to a certain antenna (or vice versa) includes an outer conductor and an inner conductor and is provided with a device acting on the carrier safety loop.

Such plug-in board are installed primarily to provide a back up or emergency service. Therefore,the positioning of the pluggable transmission line connection is rarely changed. Still, such plug-in boards should be designed with low reflection and should be secured against unintentional switching. In addition, a desired or required change should be possible in a fast manner without endangering the operator.

In general, these requirements are met by designing the pluggable transmission line connection as bow-type plug with U-shaped transmission line and with licks which are in kinematic connection with microswitches or rotary switches arranged behind the front panel of the plug-in board. The carrier safety loop is guided via the contacts of these microswitches or rotary switches with the contact being open when the locking mechanism of the bow-type plug is released.

The known plug-in boards with their bow-type plugs are thus composed of numerous and complicated parts which must be additionally mounted at narrow tolerances. Moreover, the use of switches for the carrier safety loop does not attain an absolute safety mechanism as the switches contain springs which may break and thus inadvertently keep the carrier safety loop in a closed state.

SUMMARY OF THE INVENTION

It is thus an object of the present invention to provide an improved transmitter/antenna plug-in board of the above stated type obviating the afore-stated drawbacks.

This object and others which will become apparent hereinafter are attained by extending the inner conductor of the flange sockets beyond the outer conductor contact flanges and by providing the pluggable transmission line connection with a straight inner conductor which contacts the projecting inner conductors of the flange sockets.

By substituting the conventional bow-type plug with a pluggable, straight transmission line connection,t he structure is considerably simplified and the number of parts is reduced. Also, the provision of such a pluggable line connection allows greater freedom when it comes to the design of the contacts between the straight inner conductor and the respective inner conductors of the coaxial lines which end or start in the front panel. In particular, types of contact are possible which allow a greater distance tolerance between the inner conductors linked by the pluggable line connection and/or avoid the necessity to overcome inconveniently high plugging forces or separating forcing during manual operation.

Preferably, the inner conductor of the pluggable line connection is provided in form of a strip conductor which is provided with a slot or bore at its ends for allowing contact with the inner conductor of the flange sockets. Suitably, a contact ring such as e.g. a ring of laminated springs is arranged between the contacting areas and is attached either to the strip conductor or to the end of the respective inner conductor of the flange socket. Instead of such a circumferential contacting, it is certainly feasible to provide a front contacting, especially in form of a knife contact.

A further advantage of providing a straight pluggable transmission line connection is the small overall height. Therefore, according to a further feature of the present invention, it is possible to guide the carrier safety loop electrically along the pluggable transmission line connection. This is suitably done by providing two complementary multicontact plug and socket units with one unit attached to the front panel and the other unit mounted to the pluggable transmission line connection. In this manner, an absolutely reliable braking of the carrier safety loop is obtained during withdrawal of the pluggable transmission line connection without any electrical switch gears and switches and even without any further threaded engagement or locking of the transmission line connection.

By floatingly supporting one of the two complementary plug units, considerably tolerances are possible. Moreover, the plug unit arranged in the front panel can be mounted in such a manner that a dismantling thereof is possible from the front side of the front panel.

When using plug units with a larger number of poles or plug contacts, a coding can be obtained through respective configuration of contacts in one plug unit and through provision of short-circuiting bridges in the other plug unit so that a misplacing of the pluggable transmission line connection or the use of inadmissible transmission line connections are prevented and—if necessary—a suitable feedback can be triggered. Suitable, the front panel incorporates a display unit by which a switching state of the carrier safety loop can be indicated and which is controlled via additional contacts of the plug unit.

BRIEF DESCRIPTION OF THE DRAWING

The above and other objects, features and advantages of the present invention will not be described in more detail with reference to the accompanying drawing in which:

FIG. 2 is a side view of a flange socket according to the invention; and

FIG. 3 is a partly perspective view of a modified flange socket according to the invention.

DETAILED DESCRIPTION OF PREFERRED EMBODIMENTS

Figure 1:
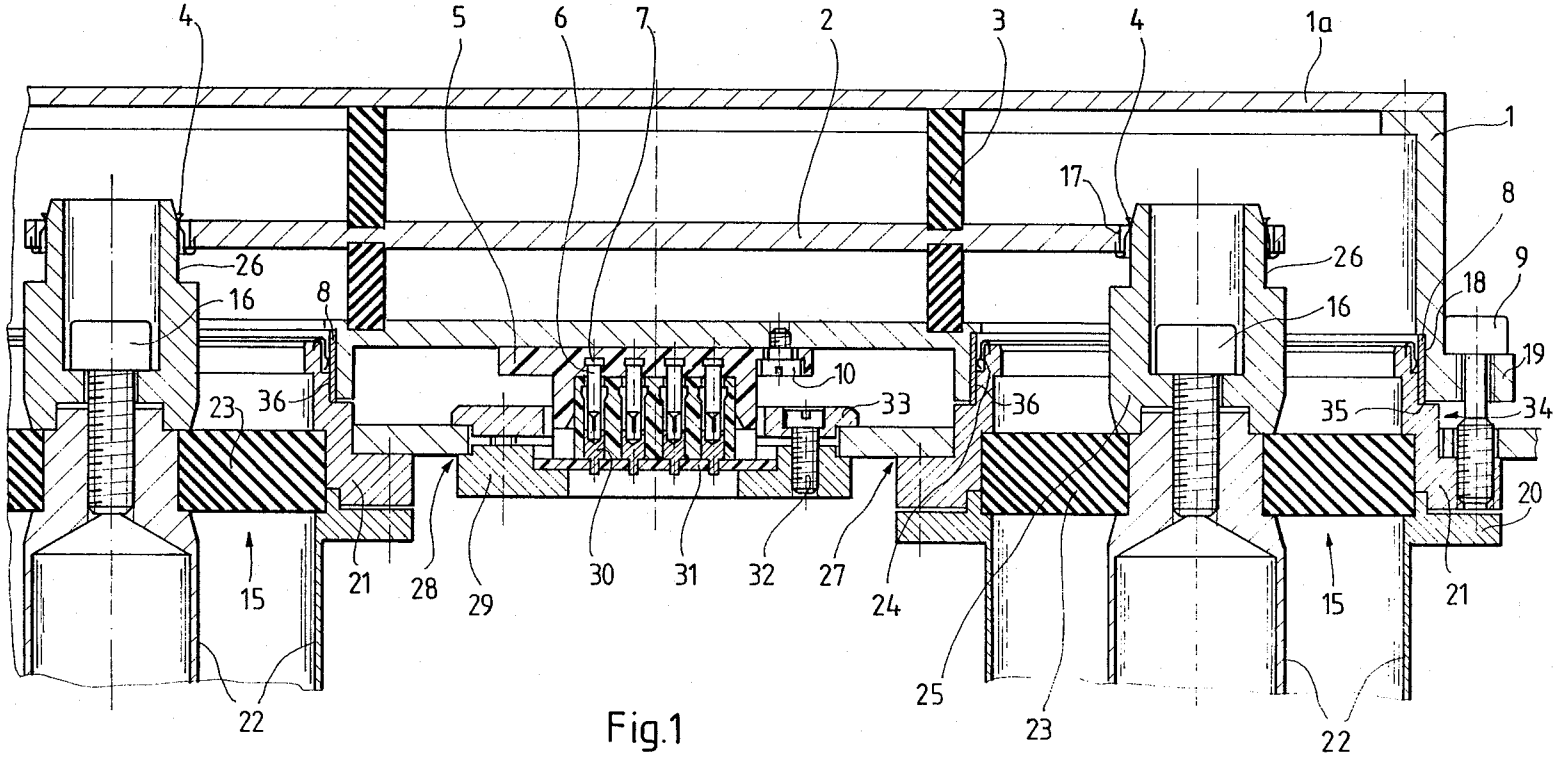
FIG. 1 is a partly cross sectional view of one embodiment of a transmitter/antenna plug-in board in accordance with the invention.

Referring now to the drawing and in particular to FIG. 1, there is shown a partly cross sectional view of a transmitter/antenna plug-in board in accordance with the present invention for selectively connecting coaxial lines such as two coaxial lines 22. The plug-in board includes a front panel 20 which accommodates flange sockets generally designated by reference numeral 15 for allowing attachment of the coaxial lines 22.

Each flange socket 15 includes an outer conductor contact flange 21 and a bead or support insulator 23 by means of which the inner conductor of the coaxial lines 22 is supported and separated from the outer conductor contact flange 21 in a position coaxial with the latter. The inner conductor of each coaxial line 22 is suitably connected to an inner conductor portion 25 by means of e.g. a bolt 16 so as to project beyond the outer conductor contact flange 21 and to extend beyond the front panel 20 even to a further degree than the outer conductor contact flange 21. At its free end, the inner conductor 25 is of reduced diameter and defines a circumferential contact surface 26.

The coaxial lines 22 are linked to each other by a pluggable transmission line connection which comprises an outer conductor 1 of preferable rectangular cross section with a lid portion 1*a* and a straight inner conductor 2 which is supported in central position coaxial to the outer conductor 1 by axially spaced beads or support insulators 3. Preferably, the inner conductor 2 is provided in form of a strip conductor which at its opposing ends is provided with a bore 17 traversed by the respective inner conductors 25. Attached within each bore 17 is a ring 4 of laminated springs which contacts the circumferential area 26 of the respective inner conductor 25. In the area of the circumferential area 26, the inner conductor 25 is of reduced diameter so as to keep the reflection coefficient as low as possible also in this area.

The outer conductor 1 of the pluggable transmission line connection is provided at each opposing end with a circular opening or bore 18 in which a radially resilient contact socket 8 is inserted. As is shown in FIG. 1, the contact socket 8 slightly projects beyond the end face of the outer conductor 1 and bears on a respective shoulder of the outer conductor contact flange 21 as generally indicated by reference numeral 34. Via the contact socket 8, the outer conductor 1 is in contact with a circumferential surface 36 of the contact flange 21. Suitably, the circumferential surface 36 simultaneously serves as a centering collar for properly positioning the contact socket 8.

At its upper section, the outer conductor contact flange 21 is slightly offset to the centering collar so as to define a space to the contact socket 8. Sandwiched in this space is an outer conductor contact ring 24 which is connected to the contact flange 21 and is in contact with the contact socket 8. As can be seen from FIG. 2 which illustrates a side view of a flange socket 15 after pulling off the pluggable transmission line connection, the outer conductor contact ring 24 is preferably of laminated structure and is designed in radially elastic manner.

At both its axial ends, the outer conductor 1 is provided with a projection 19 (only the projection at the right hand side is illustrated) which is traversed by a captive safety screw 9 threadably engaged in the outer conductor contact flange 21. By turning the safety screw 9, a front contact is attained between the outwardly projecting end section of the contact socket 8 and the respective shoulder of the contact flange 21. This additional front contact considerably improves the RF-tightness of the plug-in connection.

The contact between the outwardly projecting end section of the contact socket 8 and the contact flange 21 can further be improved by designing the shoulder of the contact flange 21 as a spring ring 35 of superimposed plates as shown in FIG. 3 in which the contact flange 21 is illustrated in a partial perspective view.

Referring now again to FIG. 1, it can be seen that the front panel 20 is provided with an opening between the flange sockets 15 for allowing floating attachment of a multicontact plug and socket unit. Extending below the front panel 20, the plug and socket unit includes a mounting flange 29 which is joined by screws 32 to a clamping plate 33 arranged above the front panel 20. The mounting flange 29 supports a carrier plate 31 in which jacks 30 are embedded in insulating material.

The complementary plug unit is attached to the exterior of the outer conductor 1 via suitable screws 10 and includes a connector casing 5 in which plug pins 6 are embedded. The plug pins 6 contact the respective jacks 30 and are connected to each other via short-circuiting bridges 7 in a manner not shown in detail. The not shown transmission lines of the carrier safety loop are soldered onto the jacks 30 at the underside of the carrier plate 31 in such a manner that the respective circuits are closed via the short-circuiting bridges 7 i.e. only when the transmission line connection is attached.

Through suitably selecting the structural dimensions, it is guaranteed that upon pulling off the pluggable transmission line connection, the carrier safety loop is initially broken, then the connection of the inner conductor part 25 is interrupted and finally the connection of the outer conductor contact flanges 21 is suspended. When attaching the transmission line connection, the contacting is obtained in reverse sequence. In order to make sure that the afore-stated condition is adhered to, the underside or inside of the front panel 20 is used as reference surface or stop surface during installation for the outer conductor contact flange 21, as indicated by reference numeral 27, and for the mounting flange 29 as indicated by reference numeral 28. The positioning of the mentioned parts relative to each other thus remains independent of the width of the front panel 20 and is constantly maintained.

While the invention has been illustrated and described as embodied in a Transmitter/Antenna Plug-In Board, it is not intended to be limited to the details shown since various modifications and structural changes may be made without departing in any way from the spirit of the present invention.

What is claimed as new and desired to be protected by Letters Patent is set forth in the appended claims.

I claim:

1. A transmitter/antenna plug-in board for selectively connecting two coaxial lines of a plurality of coaxial lines, comprising:

a front panel;

a flange socket attached to each of said coaxial lines and incorporated in said front panel, said flange socket including an outer conductor contact flange and an inner conductor projecting beyond said outer conductor contact flange; and as least one straight transmission line connection pluggable onto said flange sockets of the coaxial lines to be connected and including an outer conductor and a straight inner conductor which contacts with both its ends said projecting inner conductors of said flange sockets.

2. A plug-in board as defined in claim 1 wherein said straight inner conductor is a strip conductor which is provided with an opening at each end thereof for receiving in contacting manner the ends of said projecting inner conductors of said flange sockets.

3. A plug-in board as defined in claim 1 wherein said inner conductors of said flange sockets are each provided with a section of reduced diameter along their ends contacted by said straight inner conductor for compensation of reflection.

4. A plug-in board as defined in claim 1 wherein said outer conductor contact flange of each flange socket is provided with a centering element for contacting said outer conductor of said transmission line connection along respective circumferential areas thereof.

5. A plug-in board as defined in claim 1 wherein said outer conductor of said transmission line connection is of rectangular cross section.

6. A plug-in board as defined in claim 4, and further comprising a contact socket arranged between said circumferential areas of said outer conductor of said transmission line connection and said outer conductor contact flange of said flange sockets, said contact socket extending axially beyond the end face of said outer conductor of said transmission line connection.

7. A plug-in board as defined in claim 1, and further comprising connecting means for threadably engaging said outer conductor of said transmission line connection with said front panel, said connecting means providing an additional front contact between said outer conductor and said outer conductor contact flange of said flange sockets.

8. A plug-in board as defined in claim 1, and further comprising a contact spring ring arranged between the contacting end faces of said outer conductor of said transmission line connection and said outer conductor contact flange of said flange sockets.

9. A plug-in board as defined in claim 1, and further comprising a carrier safety loop guided electrically along said transmission line connection.

10. A plug-in board as defined in claim 9 wherein said carrier safety loop includes an at least double pole plug unit mounted in said front panel and a complementary plug unit mounted to said transmission line connection and having at least one short-circuiting bridge.

11. A plug-in board as defined in claim 9 wherein said carrier safety loop includes an at least double pole plug unit mounted in said front panel, said front panel having an area defining a reference and stop surface for mounting said flange sockets and said plug unit and wherein upon pulling off of said transmission line connection said carrier safety loop is initially interrupted, then the connection of said inner conductors is separated and finally the connection of said outer conductor contact flanges is separated.

* * * * *